US005788922A

United States Patent [19]

Magee, Jr.

[11] Patent Number: 5,788,922

[45] Date of Patent: Aug. 4, 1998

[54] FREE-MACHINING AUSTENITIC STAINLESS STEEL

[75] Inventor: John H. Magee, Jr., Reading, Pa.

[73] Assignee: CRS Holdings, Inc., Wilmington, Del.

[21] Appl. No.: 641,758

[22] Filed: May 2, 1996

[51] Int. Cl.[6] ..... C22C 38/58

[52] U.S. Cl. ..... 420/42

[58] Field of Search ..... 420/42

[56] References Cited

U.S. PATENT DOCUMENTS

| | | |
|---|---|---|
| 3,437,478 | 4/1969 | Moskowitz et al. . |
| 3,888,659 | 6/1975 | Ferree, Jr. . |
| 4,444,588 | 4/1984 | Ney, Sr. . |
| 4,613,367 | 9/1986 | Eckenrod et al. . |
| 4,784,828 | 11/1988 | Eckenrod et al. . |
| 4,933,142 | 6/1990 | Haswell, Jr. et al. . |
| 5,482,674 | 1/1996 | Kosa et al. . |

*Primary Examiner*—Deborah Yee

*Attorney, Agent, or Firm*—Dann, Dorfman, Herrell and Skillman, P.C.

[57] ABSTRACT

An austenitic, stainless steel alloy is disclosed consisting essentially of, in weight percent, about

| | |
|---|---|
| C | 0.035 max |
| Mn | 3–10 |
| Si | 1.0 max |
| P | 0.05 max |
| S | 0.15–0.45 |
| Cr | 10–20 |
| Ni | 4–8 |
| Mo | 1.0 max |
| Cu | 1.0–3.0 |
| N | 0.035 max |
| B | 0.005 max |
| Se | 0.1 max |

with the balance essentially iron. The disclosed stainless steel provides superior machinability relative to AISI Type 203 stainless steel with similar corrosion resistance, strength, ductility, hardness, and magnetic permeability.

23 Claims, No Drawings

FREE-MACHINING AUSTENITIC STAINLESS STEEL

FIELD OF THE INVENTION

The present invention relates to an austenitic stainless steel alloy and in particular to a resulfurized Fe-Cr-Ni-Mn-Cu austenitic stainless steel alloy having improved machinability relative to AISI Type 203 stainless steel, with similar levels of corrosion resistance, strength, ductility, and magnetic permeability.

BACKGROUND OF THE INVENTION

AISI Type 303 stainless steel is among the most widely used of the known stainless steels. Type 303 stainless steel is a resulfurized, Fe-Cr-Ni austenitic stainless steel having the following composition in weight percent (wt. %):

| | wt. % |
|---|---|
| C | 0.15 max |
| Mn | 2.00 max |
| Si | 1.00 max |
| P | 0.20 max |
| S | 0.15 min |
| Cr | 17.0–19.0 |
| Ni | 8.0–10.0 |
| Fe | Balance |

Type 303 stainless steel provides acceptable levels of corrosion resistance and machinability for many applications. However, its relatively high nickel content subjects it to significant variations in cost as the price of nickel fluctuates in the market.

AISI Type 203 stainless steel is a resulfurized, Fe-Cr-Ni-Mn-Cu austenitic stainless steel having the following composition in weight percent (wt. %):

| | wt. % |
|---|---|
| C | 0.08 max |
| Mn | 5.00–6.50 |
| Si | 1.00 max |
| P | 0.040 max |
| S | 0.18–0.35 |
| Cr | 16.00–18.00 |
| Ni | 5.00–6.50 |
| Mo | 0.50 max |
| Cu | 1.75–2.25 |

The balance of the alloy composition is essentially iron and commercial grades of Type 203 stainless steels typically include about 0.03–0.05 weight percent nitrogen. Type 203 stainless steel contains significantly less nickel than the Type 303 alloy and is useful for many of the same applications as the Type 303 alloy, particularly those that require a combination of good machinability, non-magnetic behavior, and good corrosion resistance. Type 203 stainless steel exhibits improved drilling characteristics relative to Type 303 stainless steel when both alloys contain about the same amount of sulfur. This improvement in drill machinability is attributed to the relatively larger amounts of manganese and copper present in the Type 203 alloy.

The benefit to machinability of reducing carbon and nitrogen in certain Fe-Cr-Ni austenitic stainless steels such as Type 303, Type 304, and Type 316 is known. However, a similar benefit in an Fe-Cr-Ni-Mn-Cu austenitic stainless steel such as Type 203 has not been demonstrated. Hitherto, no significant improvement in machinability from lowering carbon and nitrogen was expected in such stainless steels, because they were thought to have optimal machinability due, at least in part, to the increased stability of the austenitic microstructure. With the ever rising demand for machinable stainless steel alloys and the continued demand to control the cost of products made from such alloys, a need has arisen for an Fe-Cr-Ni-Mn-Cu austenitic stainless steel having better machinability than Type 203 alloy, particularly under large scale, production-type machining such as on an automatic screw machine.

SUMMARY OF THE INVENTION

The alloy according to the present invention is an austenitic stainless steel that provides improved machinability compared to AISI Type 203 alloy. The broad, intermediate, and preferred compositional ranges of the austenitic stainless steel of the alloy are as follows, in weight percent:

| | Broad | Intermediate | Preferred |
|---|---|---|---|
| C | 0.035 max | 0.030 max | 0.025 max |
| Mn | 3–10 | 4–8 | 5–7 |
| Si | 1.0 max | 1.0 max | 1.0 max |
| P | 0.05 max | 0.05 max | 0.05 max |
| S | 0.15–0.45 | 0.20–0.40 | 0.25–0.35 |
| Cr | 10–20 | 12–18 | 14–17 |
| Ni | 4–10 | 5–8 | 5.5–7 |
| Mo | 1.0 max | 1.0 max | 1.0 max |
| Cu | 1.0–3.0 | 1.5–2.5 | 1.75–2.25 |
| N | 0.035 max | 0.030 max | 0.025 max |
| B | 0.005 max | 0.005 max | 0.005 max |
| Se | 0.1 max | 0.1 max | 0.1 max |

The balance of the alloy is essentially iron except for the usual impurities found in commercial grades of such steels and minor amounts of additional elements which may vary from a few thousandths of a percent up to larger amounts that do not objectionably detract from the desired combination of properties provided by this alloy.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. Throughout this application, unless otherwise indicated, percent (%) means percent by weight.

DETAILED DESCRIPTION OF THE PREFERRED EMBODIMENTS

In the alloy according to the present invention, carbon and nitrogen are each restricted to not more than about 0.035% and better yet to not more than about 0.030% to benefit the machinability of this alloy. The best results are obtained when carbon and nitrogen are each restricted to not more than about 0.025%.

However, such low amounts of carbon and nitrogen can result in undesirable amounts of ferrite (about 10% by weight) and reduced stability of the austenitic microstructure when cold worked or machined. Accordingly, at least about 4%, better yet at least about 5%, and preferably at least about 5.5% nickel is present in the alloy to prevent excessive ferrite and promote austenite stability when the alloy is cold worked or machined. However, too much nickel adversely affects the hot workability of this alloy. Therefore, nickel is restricted to not more than about 10%, better yet to not more than about 8%, and preferably to not more than about 7%.

At least about 3%, better yet at least about 4%, and preferably at least about 5% manganese is present to promote the formation of manganese-rich sulfides which benefit machinability. In addition, free manganese reduces the work hardening rate and stabilizes the austenitic structure of the alloy during cold working or machining, which is essential at low nickel levels. However, manganese is restricted to not more than about 10%, better yet to not more than about 8%, and preferably to not more than about 7% because too much manganese impairs corrosion resistance and can result in the formation of undesirable amounts of ferrite.

At least about 1.0%, better yet at least about 1.5%, and preferably at least about 1.75% copper is present in the alloy to reduce the work hardening rate and stabilize the austenite when the alloy is cold worked, and benefit the machinability of the alloy. Also, copper is present to prevent excessive ferrite formation. However, too much copper leads to tearing when the alloy is hot worked. Therefore, copper is restricted to not more than about 3.0%, better yet to not more than about 2.5%, and preferably to not more than about 2.25%.

In the alloy according to the present invention, the elements carbon, nitrogen, nickel, manganese, and copper are balanced to insure that the alloy provides superior machinability, while maintaining a low magnetic permeability, despite the low carbon, nitrogen, and nickel contents. The manganese and copper contents are critical in achieving those characteristics.

At least about 10%, better yet at least about 12%, and preferably at least about 14% chromium is present in the alloy to benefit the alloy's general corrosion resistance. Excessive chromium can result in the formation of undesirable amounts of ferrite. Preferably, the alloy is essentially ferrite free in the wrought condition. However, in the as-cast condition, the alloy has about 2% to 10% ferrite by volume, and preferably not more than about 6% ferrite by volume. In order to control the amount of ferrite in the alloy, chromium is restricted to not more than about 20%, better yet to not more than about 18%, and preferably to not more than about 17%.

At least about 0.15%, better yet at least about 0.20%, and preferably at least about 0.25% sulfur is present in this alloy because of sulfur's beneficial effect on machinability. However, sulfur is restricted to not more than about 0.45%, better yet to not more than about 0.40%, and preferably to not more than about 0.35% due to its deleterious effect on corrosion resistance and hot and cold workability. For applications requiring a high quality surface finish, the sulfur content is restricted to not more than about 0.30%.

Additional elements such as boron, selenium, and molybdenum may be present in controlled amounts to benefit other desirable properties provided by this alloy. More specifically, a small but effective amount of boron, up to about 0.005%, can be present in the alloy to benefit hot workability. Up to about 0.1% selenium can be present in the alloy for its beneficial effect on machinability as a sulfide shape control element when the amount of sulfur present in the alloy is near the lower end of its weight percent range. Further, although molybdenum is normally present at residual levels in the alloy, a positive addition of molybdenum, up to about 1.0%, can be present in this alloy to benefit pitting corrosion resistance.

The balance of the alloy is essentially iron apart from the usual impurities found in commercial grades of stainless steels intended for similar service or use. The levels of such elements are controlled so as not to adversely affect the desired properties. In particular, although silicon can be present in the alloy from deoxidizing additions during melting, silicon is restricted to not more than about 1.0% because it strongly promotes ferrite formation, particularly with the very low carbon and nitrogen present in this alloy. Additionally, not more than about 0.05% phosphorus is present in the alloy because phosphorus contributes to embrittlement of the alloy and adversely affects its machinability.

No special techniques are required in melting, casting, or working the alloy of the present invention. Arc melting followed by argon-oxygen decarburization is the preferred method of melting and refining, but other practices can be employed. In addition, this alloy can be made using powder metallurgy techniques, such as powder injection molding, and metal injection molding techniques. This alloy can also be prepared using continuous casting techniques.

The alloy of the present invention can be formed into a variety of shapes for a wide variety of uses and lends itself to the formation of billets, bars, rod, wire, strip, plate, or sheet using conventional processes. Further, the alloy of the present invention is useful in a wide range of product applications. The superior machinability of the alloy makes it highly suitable for applications requiring large scale machining of parts, especially using automated machining equipment.

EXAMPLES

In order to demonstrate the unique combination of properties provided by the alloy according to the present invention, Examples 1 and 2 of the alloy having the compositions in weight percent shown in Table 1 were prepared. For comparison purposes, Heat A with a composition outside the range of the alloy according to this invention was also prepared. The weight percent composition of Heat A is also included in Table 1. Heat A is representative of a commercial version of AISI Type 203 alloy containing significantly higher amounts of carbon and nitrogen than the present alloy.

TABLE 1

| Ex./Ht. No. | C | Mn | Si | P | S | Cr | Ni | Mo | Cu | N |
|---|---|---|---|---|---|---|---|---|---|---|
| 1(1) | 0.021 | 5.81 | 0.42 | 0.025 | 0.27 | 16.22 | 5.88 | 0.25 | 1.93 | 0.024 |
| 2(2) | 0.022 | 6.37 | 0.38 | 0.025 | 0.26 | 16.11 | 6.40 | 0.25 | 2.19 | 0.025 |
| A(3) | 0.060 | 5.78 | 0.51 | 0.025 | 0.25 | 16.59 | 5.83 | 0.25 | 1.90 | 0.041 |

(1)Also contains 0.14% Co and 0.10% V with the balance being Fe.
(2)Also contains 0.15% Co and 0.10% V with the balance being Fe.
(3)Also contains 0.15% Co and 0.10% V with the balance being Fe.

Examples 1 and 2 and Heat A were prepared from 400 lb. heats which were induction melted under a partial pressure of argon and cast as 7.5 in. (19.0 cm) square ingots. The ingots were pressed to 4 in. (10.2 cm) square billets from a temperature of 2300° F. (1260° C.). The billets were ground to remove any surface defects and the ends were cut off. The billets were then rolled to 2.125 in. (5.40 cm) diameter bars. The bars were reheated and then processed by hot rolling to a diameter of 0.718 in. (18.2 mm) from a temperature of 2350° F. (1290° C.) . The bars were straightened, turned to a diameter of 0.668 in. (17.0 mm), pointed for cold drawing, solution annealed at 1950° F. (1066° C.) for 0.5 hours, and then water quenched. The bars were then cleaned, cold drawn to a diameter of 0.637 in. (16.2 mm), straightened, and ground to a diameter of 0.625 in. (15.9 mm).

To evaluate machinability, samples of Examples 1 and 2 and Heat A were tested on an automatic screw machine. A first form tool was used to machine the 0.625 in. (15.9 mm) diameter bars to provide parts having a contoured surface defined by a small diameter of 0.392 in. (10.0 mm) and a large diameter of 0.545 in. (13.8 mm). The large diameter was then finished, using a second or finishing form tool, to a diameter of 0.530 in. (13.5 mm). As a consequence of gradual wear induced on the first form tool by the machining process, the small diameter of the machined parts gradually increases. The tests were terminated when a 0.003 in. (0.076 mm) increase in the small diameter of the machined parts was observed. The tests were performed at speeds of 189.1 and 205.7 sfpm with a first form tool feed of 0.002 ipr using a commercially available cutting fluid. Improved machinability is demonstrated when a significantly higher number of parts is machined compared to a reference material.

The results of the machinability tests are shown in Table 2 as the number of parts machined (# of Parts). Each alloy was tested in two separate runs at 189.1 sfpm and five separate runs at 205.7 sfpm. The average values (Avg.) for each set of measurements are included in the table. The weight percents of carbon, manganese, nickel, copper, and nitrogen are also included in Table 2 for convenient reference.

TABLE 2

| | | | | | | 189.1 SFPM | | 205.7 SFPM | |
|---|---|---|---|---|---|---|---|---|---|
| Ex./Ht. No. | C | Mn | Ni | Cu | N | # of Parts | Avg. | # of Parts | Avg. |
| 1 | 0.021 | 5.81 | 5.88 | 1.93 | 0.024 | 680 | | 610 | |
| | | | | | | 700* | 690 | 620 | |
| | | | | | | | | 210 | 404 |
| | | | | | | | | 340 | |
| | | | | | | | | 240 | |
| 2 | 0.022 | 6.37 | 6.40 | 2.19 | 0.025 | 350 | | 530 | |
| | | | | | | 680* | 515 | 610 | |
| | | | | | | | | 360 | 392 |
| | | | | | | | | 230 | |
| | | | | | | | | 230 | |
| A | 0.060 | 5.78 | 5.83 | 1.90 | 0.041 | 190 | | 210 | |
| | | | | | | 170 | 180 | 240 | |
| | | | | | | | | 130 | 158 |
| | | | | | | | | 120 | |
| | | | | | | | | 90 | |

*Test terminated without a 0.003 in. (0.076 mm) increase in the small diameter of the machined part.

To evaluate mechanical properties, the 0.625 in. (15.9 mm) bars of Examples 1 and 2, as well as Heat A, were annealed at 1950° F. (1066° C.) for 0.5 hours then water quenched. Some of the bars were then cold drawn until the diameter was reduced by 9%. All of the bars were then rough turned to produce smooth tensile specimens. Each specimen was cylindrical with an overall length of 3.5 in. (8.9 cm) and a diameter of 0.5 in. (1.27 cm). A 1.0 in. (2.54 cm) long section at the center of each specimen was reduced in diameter to 0.25 in. (0.64 cm) with a minimum radius of 0.1875 in. (0.476 cm) connecting the center section to each end section of the specimen.

The mechanical properties of Examples 1 and 2 were compared with the properties of Heat A. The properties measured include the 0.2% yield strength (0.2% YS), the ultimate tensile strength (UTS), the percent elongation in four diameters (% Elong.), and the percent reduction in area (% Red.). All of the properties were measured along the longitudinal direction. The results of the measurements are given in Tables 3a and 3b. The specimens used to generate the data in Table 3a were prepared from the annealed bars, whereas the specimens used to generate the data in Table 3b were prepared from the annealed and cold drawn bars.

TABLE 3a

| Ex./Ht. No. | .2% YS (ksi/MPa) | UTS (ksi/MPa) | % Elong. | % Red. |
|---|---|---|---|---|
| 1 | 29.2/201.3 | 77.0/530.9 | 60.0 | 63.0 |
| 2 | 29.1/200.6 | 75.0/517.1 | 59.0 | 63.0 |
| A | 33.5/231.0 | 82.0/565.4 | 60.0 | 65.0 |

TABLE 3b

| Ex./Ht. No. | .2% YS (ksi/MPa) | UTS (ksi/MPa) | % Elong. | % Red. |
|---|---|---|---|---|
| 1 | 64.0/441.3 | 90.0/620.5 | 42.0 | 58.0 |
| 2 | 65.5/451.6 | 87.5/603.3 | 41.0 | 60.0 |
| A | 64.0/441.3 | 92.5/637.8 | 44.0 | 60.0 |

Table 4 shows the results of Rockwell hardness testing and magnetic permeability measurements for Examples 1 and 2 and Heat A. The magnetic permeability was measured using a Severn gage. Both properties were measured on each of three separate specimens. The reported hardness values represent an average of four separate measurements on each specimen.

TABLE 4

| Ex./Ht. | Hardness (HRB or C) | | | | Magnetic Permeability | |
|---|---|---|---|---|---|---|
| No. | Center | Midradius | Near Surface | Surface | Center | Surface |
| 1 | 88.0 | 89.5 | 95.5 | 22.5 | $1.1 < \mu < 1.2$ | $1.1 < \mu < 1.2$ |
| | 90.5 | 93.5 | 96.0 | 20.0 | $1.1 < \mu < 1.2$ | $1.1 < \mu < 1.2$ |
| | 88.0 | 91.5 | 97.0 | 21.5 | $1.1 < \mu < 1.2$ | $1.1 < \mu < 1.2$ |
| 2 | 90.0 | 91.5 | 23.5 | 28.5 | $\mu < 1.02$ | $\mu < 1.02$ |
| | 89.5 | 92.5 | 24.5 | 29.0 | $\mu < 1.02$ | $1.02 < \mu < 1.05$ |
| | 88.5 | 91.0 | 97.0 | 21.0 | $\mu < 1.02$ | $\mu < 1.02$ |
| A | 93.0 | 96.5 | 99.0 | 22.5 | $\mu < 1.02$ | $\mu < 1.02$ |
| | 93.5 | 97.0 | 23.5 | 30.5 | $\mu < 1.02$ | $\mu < 1.02$ |
| | 96.0 | 95.5 | 20.5 | 29.0 | $1.02 < \mu < 1.05$ | $1.02 < \mu < 1.05$ |

The data presented in Table 2 clearly show the superior machinability of Examples 1 and 2 compared to Heat A at the lower machining speed. Although there appears to be some overlap in individual results at the high machining speed, overall, the data show that Examples 1 and 2 are capable of providing significantly better machinability than Heat A. The data in Tables 3a, 3b, and 4 show that Examples 1 and 2 provide strength, ductility, hardness, and magnetic properties that are similar to Heat A. Thus, when considered as a whole, the data presented in Tables 2–4 illustrate the superior machinability of Examples 1 and 2 without a significant adverse effect on other desired properties of a resulfurized austenitic stainless steel.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An austenitic, stainless steel alloy having a unique combination of turning machinability, corrosion resistance, strength, ductility, and magnetic permeability, said alloy consisting essentially of, in weight percent, about

| | |
|---|---|
| C | 0.035 max |
| Mn | 4–10 |
| Si | 1.0 max |
| P | 0.05 max |
| S | 0.15–0.45 |
| Cr | 10–20 |
| Ni | 4–8 |
| Mo | 1.0 max |
| Cu | 1.5–3.0 |
| N | 0.035 max |
| B | 0.005 max |
| Se | 0.1 max |

with the balance essentially iron.

2. The alloy as recited in claim 1 which contains not more than about 0.030% carbon.

3. The alloy as recited in claim 1 which contains not more than about 0.030% nitrogen.

4. The alloy as recited in claim 1 which contains not more than about 8% manganese.

5. The alloy recited in claim 1 which contains at least about 5% nickel.

6. The alloy recited in claim 1 which contains not more than about 2.5% copper.

7. The alloy recited in claim 1 which contains not more than about 18% chromium.

8. The alloy recited in claim 1 which contains at least about 12% chromium.

9. An austenitic, stainless steel alloy having a unique combination of turning machinability, corrosion resistance, strength, ductility, and magnetic permeability, said alloy consisting essentially of, in weight percent, about

| | |
|---|---|
| C | 0.030 max |
| Mn | [4–8] 4–10 |
| Si | 1.0 max |
| P | 0.05 max |
| S | 0.20–0.40 |
| Cr | 12–18 |
| Ni | [5–8] 4–7 |
| Mo | 1.0 max |
| Cu | [1.5–2.5] 1.5–3.0 |
| N | 0.030 max |
| B | 0.005 max |
| Se | 0.1 max |

with the balance essentially iron.

10. The alloy as recited in claim 9 which contains not more than about 0.025% carbon.

11. The alloy as recited in claim 9 which contains at least about 5% manganese.

12. The alloy as recited in claim 9 which contains not more than about 7% manganese.

13. The alloy as recited in claim 9 which contains not more than about 17% chromium.

14. The alloy as recited in claim 9 which contains at least about 14 % chromium.

15. The alloy as recited in claim 9 which contains at least about 1.75% copper.

16. The alloy as recited in claim 12 which contains not more than about 2.25% copper.

17. The alloy as recited in claim 12 which contains not more than about 0.025% nitrogen.

18. An austenitic, stainless steel alloy having a unique combination of turning machinability, corrosion resistance, strength, ductility, and magnetic permeability, said alloy consisting essentially of, in weight percent, about

| | |
|---|---|
| C | 0.025 max |
| Mn | [5–7] 5–10 |
| Si | 1.0 max |
| P | 0.05 max |
| S | 0.20–0.35 |
| Cr | 14–17 |
| Ni | [5–7] 4–7 |

-continued

| | |
|---|---|
| Mo | 1.0 max |
| Cu | [1.75–2.25] 1.75–2.5 |
| N | 0.025 max |
| B | 0.005 max |
| Se | 0.1 max |

with the balance essentially iron.

19. The alloy as recited in claim 1 which contains at least about 5% manganese.

20. The alloy as recited in claim 1 which contains not more than about 0.30% sulfur.

21. The alloy as recited in claim 9 which contains not more than about 0.30% sulfur.

22. The alloy as recited in claim 18 which contains not more than about 0.30% sulfur.

23. An austenitic, stainless steel alloy having a unique combination of turning machinability, corrosion resistance, strength, ductility, and magnetic permeability, said alloy consisting essentially of, in weight percent, about

| | |
|---|---|
| C | 0.035 max |
| Mn | 5–10 |
| Si | 1.0 max |
| P | 0.05 max |
| S | 0.15–0.45 |
| Cr | 10–20 |
| Ni | [4–10] 4–7 |
| Mo | 1.0 max |
| Cu | [1.0–3.0] 1.5–3.0 |
| N | 0.035 max |
| B | 0.005 max |
| Se | 0.1 max |

with the balance essentially iron.

* * * * *